US007984867B2

(12) United States Patent
Sahlin et al.

(10) Patent No.: US 7,984,867 B2
(45) Date of Patent: Jul. 26, 2011

(54) DEVICE FOR ALIGNING THE REFINING DISC OF A REFINING APPARATUS

(75) Inventors: Tomas Sahlin, Sundsvall (SE); Göran Byström, Sundsbruk (SE); Mattias Eriksson, Sundsvall (SE)

(73) Assignee: Metso Paper, Inc. (FI)

( * ) Notice: Subject to any disclaimer, the term of this patent is extended or adjusted under 35 U.S.C. 154(b) by 158 days.

(21) Appl. No.: 12/226,791

(22) PCT Filed: May 30, 2007

(86) PCT No.: PCT/SE2007/050384

§ 371 (c)(1),
(2), (4) Date: Oct. 28, 2008

(87) PCT Pub. No.: WO2007/139504

PCT Pub. Date: Dec. 6, 2007

(65) Prior Publication Data

US 2009/0078808 A1 Mar. 26, 2009

(30) Foreign Application Priority Data

Jun. 1, 2006 (SE) ..... 0601219

(51) Int. Cl.
*B02C 7/14* (2006.01)

(52) U.S. Cl. ..... 241/259.1; 241/261.2

(58) Field of Classification Search ..... 241/37, 241/261.2, 261.3, 259.1
See application file for complete search history.

(56) References Cited

U.S. PATENT DOCUMENTS

| | | | |
|---|---|---|---|
| 3,434,670 | A | 3/1969 | May |
| 6,957,758 | B2 | 10/2005 | Aranyi |
| 2001/0020660 | A1 | 9/2001 | Antensteiner et al. |
| 2001/0022329 | A1 | 9/2001 | Antensteiner et al. |

FOREIGN PATENT DOCUMENTS

| | | | |
|---|---|---|---|
| DE | 196 28 669 | A1 | 1/1998 |
| FR | 2 499 115 | A1 | 8/1982 |
| GB | 1 468 649 | A | 3/1977 |
| GB | 2 099 746 | A | 12/1982 |
| WO | WO-89/02783 | A1 | 4/1989 |

*Primary Examiner* — Mark Rosenbaum
(74) *Attorney, Agent, or Firm* — Lerner, David, Littenberg, Krumholz & Mentlik, LLP

(57) ABSTRACT

Apparatus for aligning a refining disc is a refiner is disclosed, the apparatus including a first wedge slidable along a support for the axle package of the refining disc, a second wedge disposed between the first wedge and a bearing housing in which the rotatable axle of the axle package is journalled, the second wedge being slidable transversely to the slidable movement of the first wedge, a controller for controlling displacement of the first wedge including an actuator at one end of the support and a control axle extending from the actuator to the first wedge, the control axle being rotatable and rotatably secured to the first wedge whereby operation of the actuator causes rotation of the control axle, which in turn causes displacement of the first wedge which causes transverse displacement of the second wedge.

9 Claims, 4 Drawing Sheets

PRIOR ART
PRIOR ART

DEVICE FOR ALIGNING THE REFINING DISC OF A REFINING APPARATUS

FIELD OF THE INVENTION

The present invention relates to a device for aligning the refining disc of a refining apparatus in which lignocellulose-containing material is disintegrated and refined, which device for aligning is intended to be arranged in a support for supporting the axle package of the refining apparatus, which axle package comprises the rotary refining disc of the refining apparatus, a rotary axle to which the rotary refining disc is attached, and a bearing housing in which the axle is journalled by means of bearings arranged in the bearing housing, where the support is intended to rest on a ground surface. The present invention also relates to such a device comprising a first wedge-shaped member, which is slidable in a direction along the ground surface, and a second wedge-shaped member provided between the first wedge-shaped member and the bearing housing of the axle package, which second wedge-shaped member is slidable in a direction transverse to the sliding direction of the first wedge-shaped member, and the first wedge-shaped member when displaced in its sliding direction, is arranged to displace the second wedge-shaped member in its sliding direction. The present invention also relates to a control device for displacing the first wedge-shaped member. The present invention further relates to a support for supporting the axle package of a refining apparatus comprising such a device, and to a refining apparatus comprising such a support.

BACKGROUND OF THE INVENTION

For highly concentrated refining, CTMP, TMP, fluffing and highly concentrated grinding of sack paper and other lignocellulose-containing material, refining apparatus or disc refiners are used. Examples of refining apparatus are described in U.S. Pat. No. 6,957,758 and EP Patent No. 386;031. Refining apparatus usually comprise two opposite refining discs rotatable in relation to each other, where usually one refining disc is rotatable, a so called rotor, and one refining disc is non-rotatable, a so called stator, but in some refining apparatus both refining discs are rotatably arranged. The refining discs in this type of refining apparatus are provided with replaceable refining segments which form the refining surfaces of the refining apparatus. The refining segments comprise bars and intermediate grooves. Refining occurs between the two refining surfaces which are held at a certain distance from each other, whereby a space, known as a refining gap, is provided between the refining surfaces.

If the refining surfaces were to come in contact with each other during operation, this will result in a risk of a breakdown or at least result in wear of the refining surfaces, and thus a shortened operating performance. Furthermore, the degree of alignment between the refining surfaces has a crucial importance for the quality of the ground material. When the degree of alignment between the refining surfaces decreases, the quality of the refined material is deteriorated. A correct alignment between the refining surfaces is therefore of great importance.

To obtain a correct alignment between the refining surfaces of the refining discs it is a prerequisite that the rotation axle, to which the rotor is attached, obtains correct alignment. To angle the axle in relation to the horizontal plane and the vertical plane, two alignment devices are used, which align the whole axle package, to which the axle and the rotor belongs. Such an alignment device according to known technology is described in more detail in the detailed description in connection with FIGS. 1 to 6. The alignment of the axle package, and thus of the axle and the rotor, is performed with approximately one-month intervals for a refining apparatus in operation. The adjustment of the axle along its own longitudinal axis is performed by means of another adjustment device which displaces the whole axle package in relation to the support in the direction of the longitudinal axis of the axle. This lengthwise adjustment of the axle package, and thus of the size of the refining gap, is performed several times per second, as the refining gap often must be reduced or increased because of the constant change in the quality of the material intended for refining, such as the amount of material per time unit. To obtain correct alignment between the refining surfaces of the refining discs, an alignment of the refining surfaces themselves in relation to the refining discs also takes place. An example of alignment of the refining surfaces themselves is given in British Patent No. 1,468,649.

Certain problems exist, however, with the present alignment devices for aligning the refining disc of a refining apparatus, of which an example is described in detail in FIGS. 4 to 6.

The requirement that the contact surface of the upper wedge-shaped member against the bearing housing must form different angles with the horizontal plane so that, at different settings of the axle package, they fully bear against the exterior surface of the bearing housing, results in the requirement that the upper wedge-shaped member must rotate in relation to the horizontal plane. This "tilting" of the upper wedge-shaped member results in a relatively large sideway play between the upper wedge-shaped member and the space in the support in which the upper wedge-shaped member is provided. This play results, however, in the upper wedge-shaped member easily jamming in its installation space in the support. Furthermore, the flat contact surface of the upper wedge-shaped member against the bearing housing and the flat contact surface of the bearing housing against the upper wedge-shaped member have a very even surface as these repeatedly slide in relation to each other, which poses high requirements on the machining of these flat surfaces.

The requirement that the actuator of the alignment device must be placed on the side of the support which is facing away from the refining housing, so that the operator is able to control same, has led to a complicated construction of the alignment device, where the alignment by means of the alignment device includes many steps. This also results in a long distance between the securing point of the alignment device in the support and the lower wedge-shaped member, which leads to rendering the respective alignment device sensitive to temperature influence, and in addition the construction is not unresilient enough.

The above-mentioned problems will appear more clearly from the detailed description, where the prior art is described in more detail.

One of the objects of the present invention is thus to provide an alignment of the refining disc of a refining apparatus, which is reliable in service and straightforward to perform.

SUMMARY OF THE INVENTION

In accordance with the present invention, this and other objects have now been realized by the discovery of apparatus for aligning a refining disc in a refiner for disintegrating lignocellose-containing material, the refiner including an axle package and a support for supporting the axle package with respect to the ground, the axle package including a rotatable axle attached to the refining disc and a bearing housing in which the rotatable axle is journalled, the bearing housing including bearings for the axle to facilitate rotation thereof, the apparatus comprising a first wedge member slidable along the support, a second wedge member disposed between the first wedge member and the bearing housing, whereby the bearing housing rests upon the second wedge member, the second wedge member slidable in a transverse direction to the slidable movement of the first wedge member, a controller for controlling the displacement of the first wedge member, the controller comprising an actuator disposed at one end of the support and a control axle extending from the actuator to the first wedge member, the control axle being rotatable about its longitudinal axis and being rotatably secured to the first wedge member, whereby operation of the actuator causes rotation of the control axle, which causes displacement of the first wedge member, which causes transverse displacement of the second wedge member. Preferably, the controller further comprises at least one controller bearing housing, the controller bearing housing being attached between the actuator and the first wedge member. In a preferred embodiment, the control axle comprises first and second sub-axle portions, and a shaft coupling for coupling together the first and second sub-axle portions, the at least one controller bearing housing being attached between the shaft coupling and the first wedge member, and the first sub-axle portion being attached to the first wedge member and journalled by the bearings of the at least one controller bearing housing.

In accordance with one embodiment of the apparatus of the present invention, the control axle includes a threaded section for attaching the control axle to the first wedge member, and including an inner threaded member in engagement with the threaded section of the control axle and fixedly engaged to the first wedge member, the first wedge member being displaceable with respect to the control axle. Preferably, the threaded section of the control axle and the inner threaded member comprise parts of a ball screw.

In accordance with another embodiment of the apparatus of the present invention, the apparatus includes a support member for supporting the bearing housing, the support member being disposed between the second wedge member and the bearing housing, the bearing housing including a recess for accepting the support member, whereby the support member is adapted to engage the recess in the bearing housing, the support member having a convex contact surface for engagement with the recess in the bearing housing, the convex contact surface being displaceable with respect to the surface of the recess in the bearing housing. Preferably, the apparatus includes a plate comprising a polymer material disposed between the support member and the second wedge member, thereby providing a sliding surface therebetween without the need for lubrication. In a preferred embodiment, the plate has a length corresponding to the length of the portion of the support member proximate to the second wedge member. In another embodiment, the support member is secured to the bearing housing.

In accordance with the present invention, a support is provided for an axle package for a refining disc in a refiner for disintegrating lignocellose-containing material, the axle package including a rotatable axle attached to the refining disc and a bearing housing in which the rotatable axle is journalled, the bearing housing including bearings for the axle to facilitate rotation thereof, the support comprising a pair of alignment devices for aligning the refining disc, at least one of the pair of alignment devices comprising the apparatus discussed above.

In accordance with the present invention, a refining apparatus for disintegrating and refining lignocellose-containing material comprising a refining disc and an axle package for the refining disc including a rotatable axle attached to the refining disc and a bearing housing in which the rotatable axle is journalled, the bearing housing including bearings for the axle to facilitate rotation thereof, and a support as discussed above.

In accordance with the present invention, an alignment is provided which comprises a minimum number of steps. In principle, only a rotation of the actuator in one direction is needed for the alignment. By means of this device the distance between the fastening point of the device in the support and the first wedge-shaped member is radically reduced. In this way, a control is also achieved which is uncomplicated in its construction and requires a considerably less twisting moment upon alignment compared to prior art alignment devices.

According to an advantageous embodiment of a device according to the present invention, the control device comprises at least one bearing housing with bearings by which the control axle is journalled, the bearing housing being fastened in the support between the first member and the actuator. In this way a short distance is obtained between the fastening point of the device in the support, which is the same as the fastening point of the bearing housing of the device in the support, and the first member.

According to a further advantageous embodiment of the device according to the present invention, the control axle comprises two sub-axles which are coupled together by means of a shaft coupling which is part of the control device, where the bearing housing of the control device is fastened in the support between the shaft coupling and the first member, and the sub-axle which is secured to the first member is journalled by the bearing of the bearing housing. The shaft coupling allows the longitudinal axes of the sub-axles to be angled in relation to each other without having the sub-axles rotating around their longitudinal axis in relation to each other, i.e. they do not rotate in relation to each other in their rotation direction.

According to another advantageous embodiment of the device according to the present invention, the control axle is secured to the first member by a threaded section provided on the control axle, which is in engagement with a means provided with an inner thread, which is fixedly secured in the first member, the first member being displaceable in relation to the control axle. Advantageously, the axle comprising the threaded section and the means are integral parts of a ball screw. By means of the ball screw, also called a roll screw, a securing mechanism free from play of the control axle in the first member is achieved.

According to an advantageous embodiment of the device according to the present invention, the device comprises support means on which the bearing housing is intended to rest, which support means is provided between the second member and the bearing housing and arranged to engage with the complementary recess of the bearing housing, the support means having a convex contact surface against the recess of the bearing housing, and the convex contact surface of the support means is displaceable in relation to the surface of the complementary recess of the bearing housing.

In this manner, the second wedge-shaped member, which is situated above the first wedge-shaped member, does not need to be rotatable in relation to the horizontal plane, whereby the problematic "tilting" of the second wedge-shaped member does not occur, and that member can be installed in its installation space/its guide without lateral play, whereby the risk that the wedge-shaped member jams in its installation space in the support is eliminated. The requirement that the flat surfaces must be very even does not exist any more, as the main displacement occurs between the convex and concave surfaces.

As the bearing housing, by means of the surface of the complementary recess, rests on the convex contact surface, these are in contact with each other, and the displaceability of the convex contact surface of the support means in relation to the surface of the complementary recess of the bearing housing results in the convex contact surface being displaceable along the surface of the complementary recess while there is surface contact between them. The convex contact surface can advantageously move in all directions along with and in contact with the surface of the complementary recess.

According to an advantageous embodiment of the device according to the present invention, the device comprises a plate of polymer material which is provided between the support means and the second wedge-shaped member, whereby a sliding surface without the need for lubricating oil is obtained, and advantageously the plate of polymer material has an extent corresponding to the base of the support means which is facing the second member. In this manner, there is no longer a need for the complicated feed of lubricating oil to the contact surface of the upper wedge-shaped member against the bearing housing as in the prior art.

According to a further advantageous embodiment of the device according to the present invention, the support means is secured to the bearing housing. This facilitates mounting of the bearing housing in the support. This securing does however not fixate the support means, but it allows displacement of the support means in relation to the bearing housing.

In accordance with the present invention, an operator can control the actuator manually. The control device of the device according to the present invention can advantageously also be connected to a control apparatus for controlling the alignment between the refining surfaces for the two opposite refining discs rotatable in relation to each other and included in a refining apparatus, where the material is disintegrated and refined in the refining gap between the refining surfaces, and the device of the present invention is advantageously arranged to automatically align the rotatable refining disc of the refining apparatus based on this control until a correct alignment is obtained between the refining surfaces, which can, for example, be achieved by the fact that the actuator of the control device is connected to the control apparatus, for example connected by means of a control unit arranged to control the actuator based on the results of the control by the control apparatus. The alignment between the refining surfaces is correct when the width of the refining gap is kept constant for every diameter for a complete revolution.

BRIEF DESCRIPTION OF THE DRAWINGS

The present invention will now be described, for exemplary purposes, in more detail in by means of embodiments and with reference to the accompanying drawings in which.

DETAILED DESCRIPTION

Figure 1:
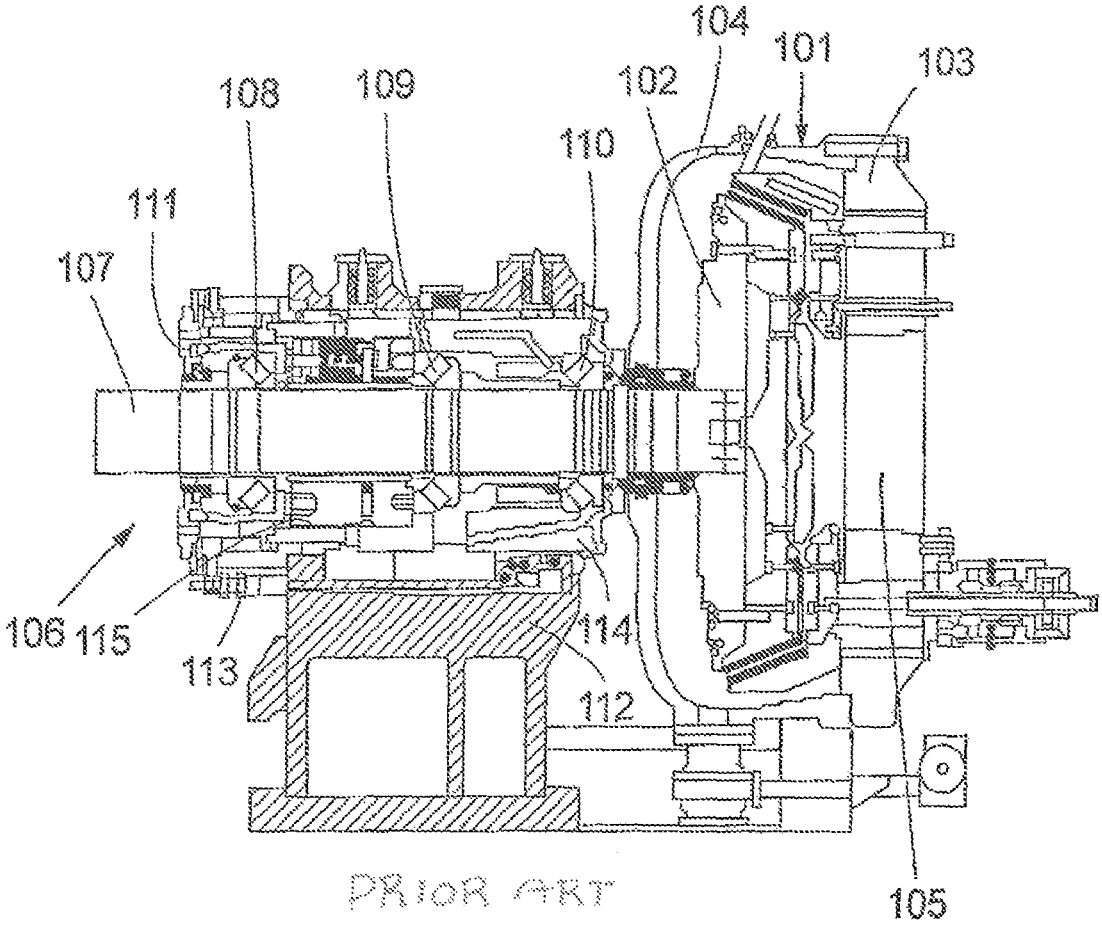
FIG. 1 is a side, elevational, cross-sectional, schematic view of a refining apparatus, equipped with alignment devices according to the prior art.

Referring to the figures, in which like reference numerals refer to like elements thereof, FIG. 1 shows in outline a refining apparatus, in the form of a so called CD-refiner (Conical Disc), in cross-section as seen from the side, for disintegration and refining of lignocellulose-containing material in a refining gap 101 between refining surfaces on two opposite refining discs, 102 and 103, rotatable in relation to each other, in the form of a rotatable rotor 102 and a non-rotatable stator 103. The refining discs, 102 and 103, are provided in a refining housing 104 and the material for refining is fed to the refining gap 101 through an inlet 105. The rotor 102 is a part of what is called an axle package 106 and this axle package 106 comprises a rotatable axle 107, the rotor 102 being attached to one of the ends of the axle 107. The axle 107 is brought into rotation by a suitable drive (not shown). The axle 107 is supported by a rear bearing 108, an intermediate bearing 109 and a front bearing 110. All the bearings are arranged in a bearing housing 111 through which the axle 107 extends. The bearing housing ill is in its turn arranged in a support 112. To obtain a correct alignment between the refining surfaces of the refining discs, 102 and 103, it is a prerequisite that the axle 107, and thereby the rotor 102, first obtains a correct alignment. To adjust the alignment of the bearing housing and the axle 107, two alignment devices are used, of which only one alignment device 113 may be seen in FIG. 1. This alignment device 113 is described in more detail in connection with FIGS. 4 to 6.

Figure 2:
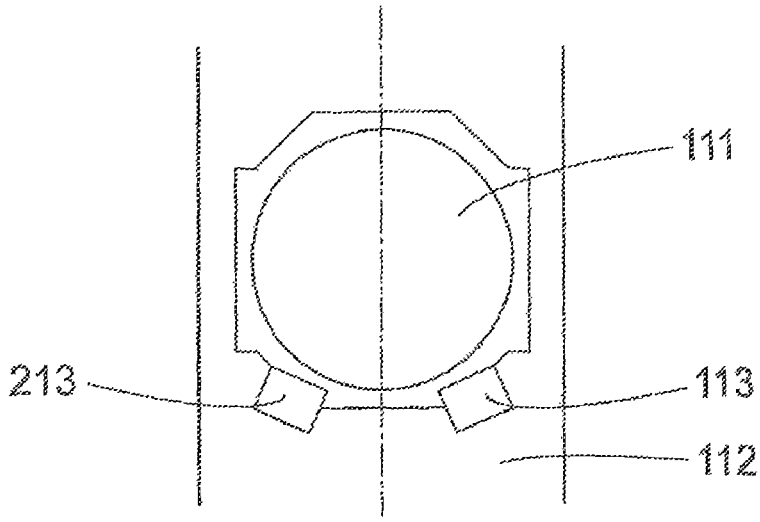
Fig. 2 PRIOR ART
FIG. 2 is a front, elevational, cross-sectional, schematic view of the refining apparatus in FIG. 1.

FIG. 2 shows a schematic front view of the refining apparatus in FIG. 1, in cross-section, where the bearing housing 111 is installed in the support 112. Here, both alignment devices, 113 and 213, are shown, as well as the manner in which they are placed in the support 112. The bearing housing 111 is cylindrical with a substantially circular cross-section. Where the bearing housing 111 abuts against the alignment devices, 113 and 213, the bearing housing 111 has flat surfaces which have been provided by milling.

Returning to FIG. 1, the front part 114 of the bearing housing 111, which is adjacent to the refining housing 104, is supported by respective alignment device 113 while the rear part 115 of the bearing housing 111 is directly supported by the support 112. The alignment devices 113 adjust the alignment of the axle 107 by respectively raising and lowering the front part 114 of the bearing housing 111 and/or displacing the front part 114 of the bearing housing 111 sideways, while the position of the rear part 115 is kept unchanged.

Figure 3:
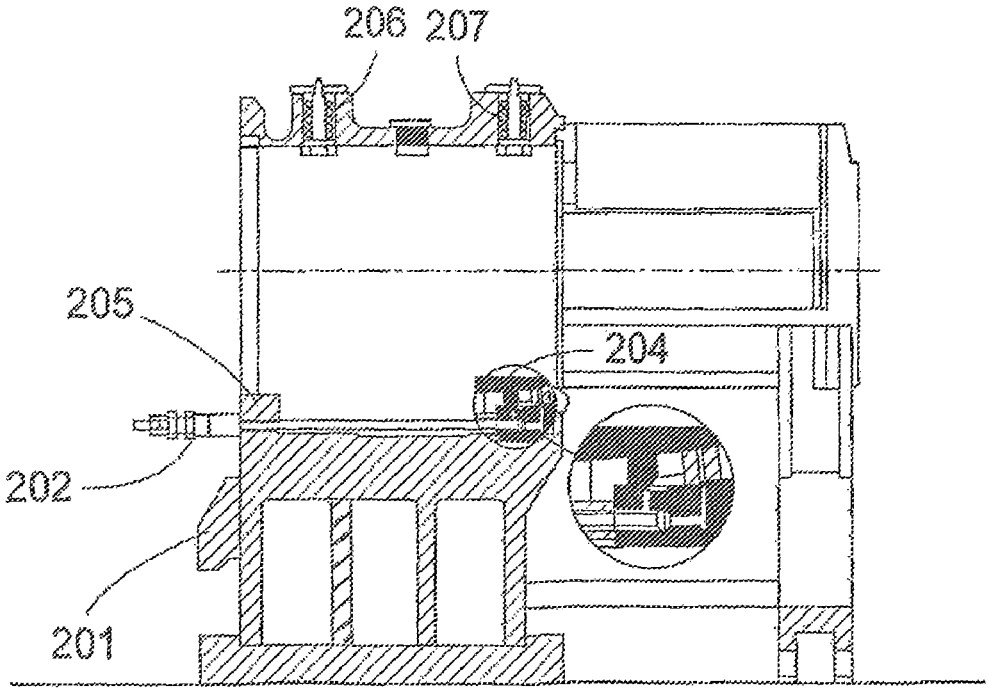
Fig. 3 PRIOR ART
FIG. 3 is a side, elevational, cross-sectional schematic view of a support for supporting the axle package, equipped with alignment devices according to the prior art.

FIG. 3 shows a support 201, without the axle package mounted, and shows one of the alignment devices 202 installed in the lower part of the support 201, and the front part of the bearing housing is supported by a support means 204, which is a part of the alignment device 202, and the rear part of the bearing housing rests on a lower rear portion 205 of the support 201, and the bearing housing is supported at the top in principle by two retaining means, 206 and 207, arranged in the upper part of the support. The bearing housing is supported in the corresponding manner on the other side of its symmetry line by the second alignment device (not shown). The support 201 rests on a ground surface 208.

Figures 4, 5, 6:
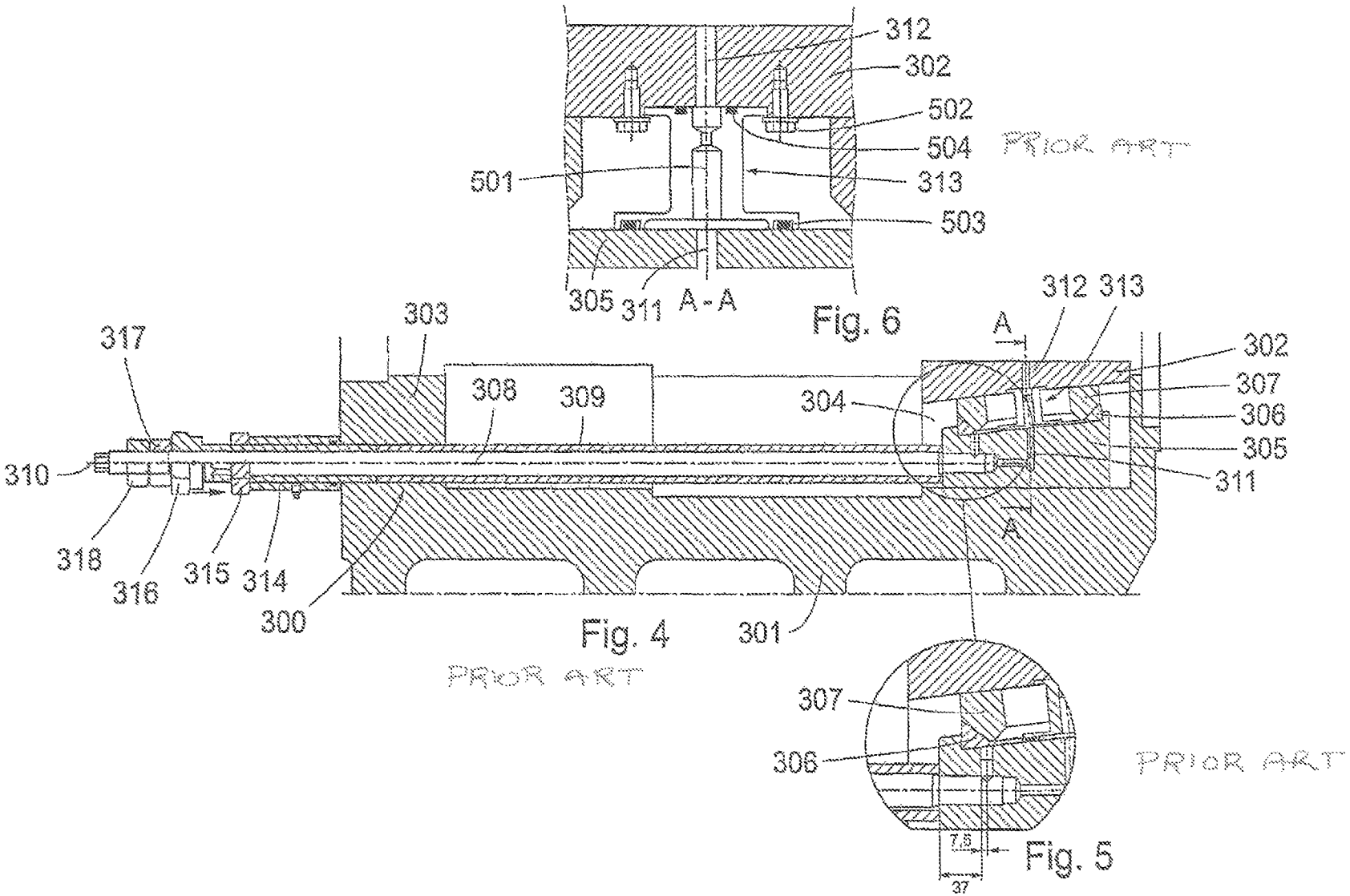
PRIOR ART Fig. 4
FIG. 4 is a side, elevational, cross-sectional, schematic view of an alignment device according to the prior art.
FIG. 5 is a side, elevational, cross-sectional view of a detail in FIG. 4.
FIG. 6 is a side, elevational, cross-sectional view of a portion of FIG. 4, shown along section a-A thereof.

FIG. 4 shows an alignment device according to the prior art, which is arranged in a support 301 in which the bearing housing is mounted and by which support the axle package is supported. The bearing housing is supported at the base by a support means 302, which is a part of the alignment device, and by a lower part 303 of the support 301. The first support means 302 is vertically slidable, while the second support means 303 is stationary. The first support means 302 is in the form of an upper wedge-shaped member 302 and this member 302 is movably arranged in a space 304 in the support 301. In the same space 304 a pad 305, in the form of a lower wedge-shaped member 305, is arranged and rests on the bottom of space 304. The lower member 305 is horizontally slidable. A bearing housing washer 306, which is ring-shaped when seen from above, rests on the upper surface of the lower member 305. On this bearing housing washer 306 a bearing washer 307 rests, which when seen from above is also ring-shaped. The bearing housing washer 306 and the bearing washer 307 are displaceable in relation to each other, and the bearing housing washer 306 is usually made of a hard material, such as stainless steel, while the bearing washer 307 is made from a softer material, such as bronze. The upper member 302 rests on the bearing washer 307. The inner walls of the space 304 prevent the lateral displacement of the upper wedge-shaped member 302. The contact surface of the upper member 302 against the bearing housing must, however, be able to form different angles with the horizontal plane to fully lie against the outer surface of the bearing housing at different adjustments of the axle package. The rotation of the upper member 302 in relation to the horizontal plane is achieved by bearing housing washer 306 and bearing washer 307. This "tilting" of the upper member 302 entails that there must be a relatively large sideway play between the side edges of the upper member 302 and the inner walls of the space 304. However, this play entails that the upper member 302 can easily jam into space 304 when an alignment of the axle package is to be performed. Further, the flat contact surface of the upper wedge-shaped member 302 against the bearing housing and the flat contact surface of the bearing housing against the upper wedge-shaped member 302 must be very even as these repeatedly slide in relation to each other.

In FIG. 5 it can be seen that the bearing housing washer 306 and the bearing washer 307 are spherical in their design, and the contact surface of the bearing housing washer 306 against the bearing washer 307 is concave, while the contact surface of the bearing washer 30 against the bearing housing washer 306 is convex in cross-section.

Returning to FIG. 4, the alignment device further includes a control device 300 arranged to push the lower member 305 to the left and right in FIG. 3. The control device 300 comprises a spacing screw 308 and a spacing tube 309 in which the spacing screw is provided, and the first end of the spacing screw 308 is fixedly secured in the lower member 305. The spacing screw 308 is hollow along its whole length and in its second end there is an inlet 310 arranged, through which inlet 310 lubricating oil is introduced to the longitudinal channel of the spacing screw 308, whereupon the lubricating oil is led to the first end of the spacing screw 308 and thereby to a first vertical channel 311 in the lower member 305. The lubricating oil is then led from the first vertical channel 311 to a second vertical channel 312 arranged in the upper member 302 through a lead-through device 313, which is described in more detail in connection with FIG. 6. From the second vertical channel 312 the lubricating oil is then led out onto the contact surface of the upper member 302 against the bearing housing. A lubrication of the contact surface between the upper member 302 and the bearing housing has been necessary in order to maintain a low friction between them, because the upper member 302 and the bearing housing slide in relation to each other when the axle package, as has been described in the introduction, is displaced in relation to the support in a direction along the longitudinal axis of the axle during the frequently occurring adjustment of the size of the refining gap. The control device 300 also comprises a console 314 which is fixedly arranged in the support 301 and a nut locking 315 fixedly arranged in the console 314. Further, the control device 300 comprises actuators, 316, 317 and 318, which are those means operated by the operator in order to align the axle package. The actuators, 316, 317 and 318, comprise an adjustment screw 316 with an exterior thread which is set against the spacing tube and is in threaded engagement with the nut locking 315. There are furthermore two jamb nuts, 317 and 318, belonging to the actuators, 316, 317 and 318, which are in threaded engagement with the spacing screw 308. These jamb nuts, 317 and 318, are used for bracing the lower member 305 at the desired position, to eliminate play. The actuators, 316, 317 and 318, are as can be seen arranged in the rear part of the support 301. This is the case since it is not practically possible to arrange the actuators, 316, 317 and 318, in the front part of the support 301, i.e. the part which is adjacent to the refining housing, to the right of the lower member 305, as an operator then would not be able to operate the actuators due to the narrow space between the front part of the support 301 and the refining housing. The consequence is a long distance between the fixing point of the alignment device in the support, which is at the nut locking 315, and the lower member 305, which entails that the alignment device is sensible for temperature influence and the construction is not rigid enough.

To lower the upper member 302 in a vertical direction, the operator starts by loosening the jamb nuts, 317 and 318, whereupon the operator turns the adjusting screw 316 so that it is displaced to the right in FIG. 3, or in a direction towards the refining housing, in relation to the support 301. The adjustment nut 316 then pushes the spacing tube 309 so it also is displaced to the right in relation to the support 301, and thereby pushes the lower member 305 to the right in the figure. The lower member 305 then also pulls the spacing screw 308 with it so that this is also displaced to the right. By displacement of the lower member 305 to the right, the bearing housing washer 306 and the bearing washer 307 are also displaced to the right, whereby the upper member 302 is lowered in a vertical direction. Finally the jamb nuts, 317 and 318, are turned so that they are displaced in a direction towards the adjustment screw 316, so that the lower member 305 is tightened against the spacing tube 309 by the displacement of the spacing screw 308 to the left in relation to the spacing tube 309, and play is eliminated.

To raise the upper member 302 in a vertical direction the operator also in this case starts by loosening the jamb nuts, 317 and 318, whereupon the operator turns the adjusting screw 316 so that it is displaced to the left in FIG. 3, or in a direction away from the refining housing, in relation to the support 301. A space arises between the adjustment screw and the spacing tube 309. Thereafter the jamb nuts, 317 and 318, are turned so they are displaced in a direction towards the adjustment screw 316, whereby the spacing screw 308 is pulled to the left and thereby pulls the lower member 305 to the left, and the lower member 305 pushes the spacing tube to the left. Due to the fact that the lower member 305 is displaced to the left, the bearing housing washer 306 and the bearing washer 307 are also displaced to the left, whereby the upper member 302 is raised in a vertical direction. To raise the upper member 302 in a vertical direction, more operations than when lowering the same are thus required.

Due to the fact that two such alignment devices are arranged in the support, as seen in FIG. 2, the front part of the axle, which is fastened to the rotor, can be laterally and/or vertically displaced.

FIG. 6 shows a detailed view of the lead-through device 313 provided between the upper member 302 and the lower member 305. The lead-through device 313 includes a channel 501, which connects to the first vertical channel 311 in the lower member 305 and to the second vertical channel 312 in the upper member 302. The lead-through device 313 is fastened in the upper member 302 with a screw 502 but is displaceable in relation to the lower member 305. The lead-through device 313 further comprises a first O-ring seal 503 for the sealing between the lead-through device 313 and the lower member 305 and a second O-ring seal 504 for the sealing between the lead-through device 313 and the upper member 302, so that the lubricating oil cannot leak out on its way to the upper member's 302 contact surface against the bearing housing. However, this need of lubricating oil implies a complicated construction comprising the lead-through device 313 and all of the channels, as described above, and also a lubricating oil source must be connected to the inlet 310 of the spacing screw 308, and this lubricating oil source must be controlled and maintained.

Figure 7:
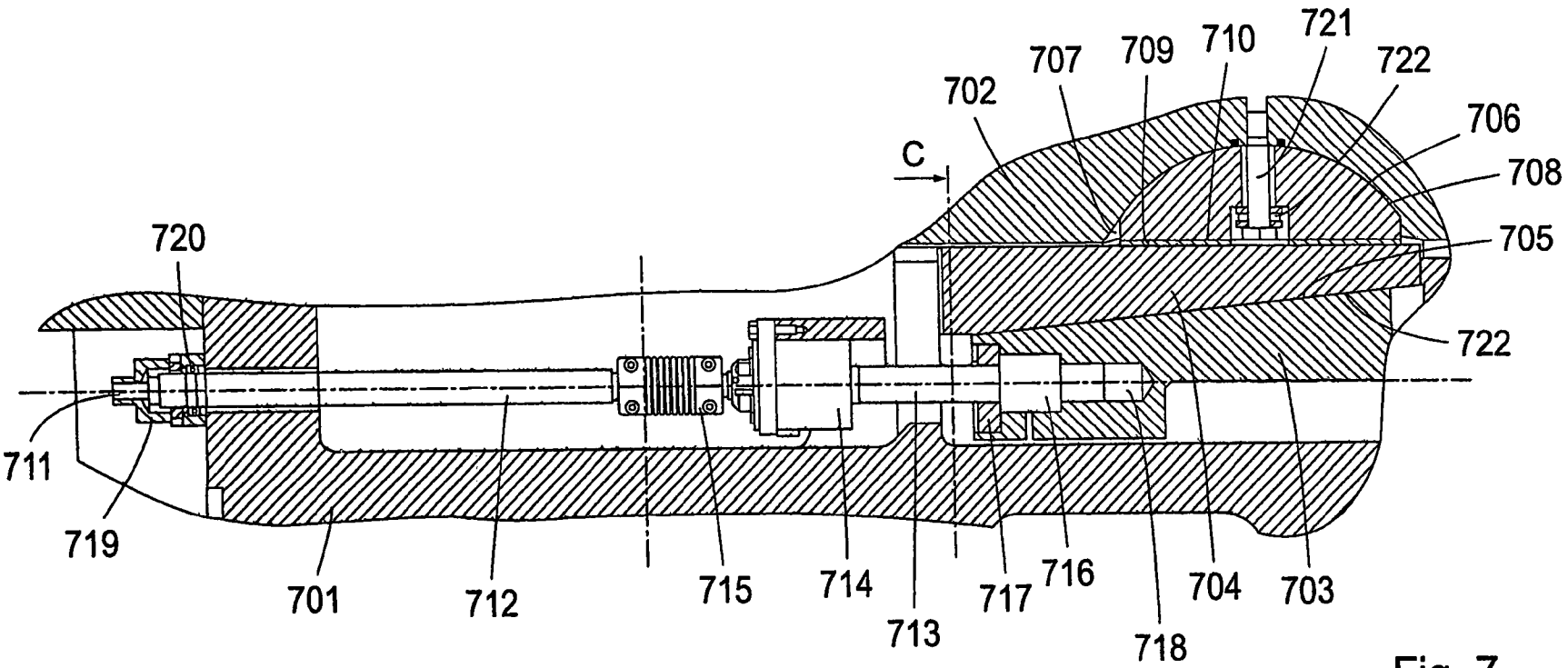
FIG. 7 is a side, elevational, cross-sectional, schematic view of an embodiment of the device for aligning the refining disc of a refining apparatus according to the present invention.

FIG. 7 shows an embodiment of the device for aligning the refining disc of a refining apparatus according to present invention, arranged in a support 701 intended to rest on a ground surface, where the bearing housing 702 of the axle package and the support 701 are only partially shown. In the same way as shown in FIG. 2, two such devices for aligning the refining disc are used, and the device according to the present invention is intended to be mounted on the corresponding places shown in FIGS. 1 to 3. The device comprises a first wedge-shaped member 703, which is slidable, in relation to the support, in a direction along the ground surface, and a second wedge-shaped member 704 provided between the first wedge-shaped member 703 and the bearing housing 702 of the axle package, which second member 704 is slidable, in relation to the support, in a direction transverse to the sliding direction of the first member. When displaced in its sliding direction, the first member 703 is arranged to displace the second member 704 in its sliding direction. The first member has a contact surface 705 against the second member 704, and the second member 704 has a contact surface 722 against the first member 703, which contact surfaces, 705 and 722, form an angle with the ground surface. During the displacement of the first member 703 to the right in the figure, i.e. towards the refining housing, the second member 704 sinks downwards in a vertical direction by the influence of gravity, and during displacement of the first member 703 to the left in the figure, i.e. away from the refining housing, the second member 704 is raised in a vertical direction, whereby the desired alignment can be achieved.

The device comprises a control device for displacing the first member 703, which control device comprises an actuator 711 arranged at the side of the support 701, which is opposite the side of the support 701 adjacent to the refining hosing. The control device comprises a control axle, 712 and 713, which extends from the actuator 711 to the first member 703. The control axle, 712 and 713, is rotatable around its longitudinal axis and comprises two sub-axles, 712 and 713, which are coupled together by means of a shaft coupling 715. The control axle, 712 and 713, is by means of its first sub-axle 713, rotatably secured to the first member 703 by a threaded section provided on the first sub-axle 713, which section is in engagement with a means 716 with an inner thread which in its turn is fixedly secured to the first member 703 by means of an fastening flange 717. The first sub-axle 713 including the threaded section and the means 716 with the inner thread are parts of a ball screw/roll screw. The first member 703 is arranged to be displaced upon rotation of the control axle, 712 713, and is slidable in its sliding direction in relation to the control axle, 712 and 713. To allow this relative displacement the first member 703 comprises a space 718 for the first sub-axle 713, which has a sufficient extent in the sliding direction of the first member 703. The rotation of the control axle, 712 and 713, is operated by the actuator 711 which is fixated in the control axle, 712 and 713. The only operation which is required for displacement of the first member 703 is thus a rotation of the actuator 711 which causes a rotation of the control axle, 712 and 713, and thereby a displacement of the first member 703. The control device comprises a bearing housing 714 with bearings by which the control axle 712, 713 is journalled by means of its first sub-axle 713. The bearing housing 714 of the control device is fastened to the support 701 between the shaft coupling 715 and the first member 703. At the actuator 711 there is arranged a nut locking 719 for locking the actuator 711, and a deep groove ball bearing 720 arranged for journaling the outer end of the control axle, 712 and 713.

Further, the device comprises a support means 706 on which the bearing housing 702 is intended to rest. The support means 706 is provided between the second member 704 and the bearing housing 702 and is arranged to engage with a to the support means 706 complementary recess 707 of the bearing housing. The support means 706 has a convex contact surface 708 against the recess 707 of the bearing housing 702, and the convex contact surface 708 of the support means 706 is displaceable in relation to the surface of the complementary recess 707 of the bearing housing 702. The device comprises a plate 709 in a polymer material, in this embodiment a web-reinforced, polyester based thermoset plastic material, which plate 709 is provided between the support means 706 and the second wedge-shaped member 704, whereby a sliding surface is achieved, so that the axle package, as described in the beginning, can be displaced in relation to the support 701 in a direction along the longitudinal axis of the axle, during the frequently occurring adjustment of the size of the refining gap, without the need for lubrication oil. Plate 709 has an extent which corresponds to the bases 710 of the support means 706, which base is facing the second member 704. To facilitate mounting of the bearing housing 702 in the support 701, the support means 706 is secured to the bearing housing 702 by means of a fastening means 721. This fastening means 721 is fastened to the support means 706 by means of spring means 722 to allow the displacement of the support means 706 in relation to the bearing housing 702.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for aligning a refining disc in a refiner for disintegrating lignocellose-containing material, said refiner including an axle package and a support for supporting said axle package with respect to the ground, said axle package including a rotatable axle attached to said refining disc and a bearing housing in which said rotatable axle is journalled, said bearing housing including bearings for said axle to facilitate rotation thereof, said apparatus comprising a first wedge member slidable along said support, a second wedge member disposed between said first wedge member and said bearing housing, whereby said bearing housing rests upon said second wedge member, said second wedge member slidable in a transverse direction to said slidable movement of said first wedge member, a controller for controlling the displacement of said first wedge member, said controller comprising an actuator disposed at one end of said support and a control axle extending from said actuator to said first wedge member, said control axle being rotatable about its longitudinal axis and being rotatably secured to said first wedge member, whereby operation of said actuator causes rotation of said control axle, which causes displacement of said first wedge member, which causes transverse displacement of said second wedge member.

2. The apparatus of claim 1 wherein said controller further comprises at least one controller bearing housing, said controller bearing housing being attached between said actuator and said first wedge member.

3. The apparatus of claim 2 wherein said control axle comprises first and second sub-axle portions, and a shaft coupling for coupling together said first and second sub-axle portions, said at least one controller bearing housing being attached between said shaft coupling and said first wedge member, and said first sub-axle portion being attached to said first wedge member and journalled by said bearings of said at least one controller bearing housing.

4. The apparatus of claim 1 wherein said control axle includes a threaded section for attaching said control axle to said first wedge member, and including an inner threaded member in engagement with said threaded section of said control axle and fixedly engaged to said first wedge member, said first wedge member being displaceable with respect to said control axle.

5. The apparatus of claim 4 wherein said threaded section of said control axle and said inner threaded member comprise parts of a ball screw.

6. The apparatus of claim 1 wherein said apparatus includes a support member for supporting said bearing housing, said support member being disposed between said second wedge member and said bearing housing, said bearing housing including a recess for accepting said support member, whereby said support member is adapted to engage said recess in said bearing housing, said support member having a convex contact surface for engagement with said recess in said bearing housing, said convex contact surface being displaceable with respect to the surface of said recess in said bearing housing.

7. The apparatus of claim 6 including a plate comprising a polymer material disposed between said support member and said second wedge member, thereby providing a sliding surface therebetween without the need for lubrication.

8. The apparatus of claim 7 wherein said plate has a length corresponding to the length of the portion of said support member proximate to said second wedge member.

9. The apparatus of claim 6 wherein said support member is secured to said bearing housing.

* * * * *